US007254847B2

(12) United States Patent
Kunkel

(10) Patent No.: US 7,254,847 B2
(45) Date of Patent: Aug. 14, 2007

(54) RIBBON FLOW WATERFALL FOR SPAS

(75) Inventor: Richard Kunkel, Murrieta, CA (US)

(73) Assignee: Watkins Manufacturing Corporation, Vista, CA (US)

( * ) Notice: Subject to any disclaimer, the term of this patent is extended or adjusted under 35 U.S.C. 154(b) by 287 days.

(21) Appl. No.: 10/816,505

(22) Filed: Apr. 1, 2004

(65) Prior Publication Data

US 2005/0223490 A1 Oct. 13, 2005

(51) Int. Cl.
*E04H 4/00* (2006.01)

(52) U.S. Cl. ..... 4/507; 4/678

(58) Field of Classification Search ..... 4/507, 4/678; 239/18, 20

See application file for complete search history.

(56) References Cited

U.S. PATENT DOCUMENTS 5,249,744 A * 10/1993 Ruthenberg ..... 4/507 X
6,210,568 B1 4/2001 Harder ..... 4/507 X
6,367,100 B2 * 4/2002 Koren et al. ..... 4/507
6,375,342 B1 * 4/2002 Koren et al. ..... 239/18 X
6,450,418 B1 * 9/2002 Simpson et al. ..... 4/507 X
6,484,952 B2 11/2002 Koren ..... 239/18
6,595,675 B2 * 7/2003 Dongo ..... 362/562

OTHER PUBLICATIONS

Oreq Corporation product catalogue. Copyright 2001, 32 pgs.

* cited by examiner

*Primary Examiner*—Robert M. Fetsuga

(57) ABSTRACT

A flat ribbon-shaped waterfall for a portable spa is caused to flow out of the top rim or top side of a spa. A narrow elongated spout forms the output end of a plenum chamber that has a water inlet. The plenum chamber is constructed to baffle surges in the inlet water flow. A light source is placed close to the mouth of the elongated spout to light the ribbon of water flowing from the spout in multi-color, if desired.

11 Claims, 5 Drawing Sheets

RIBBON FLOW WATERFALL FOR SPAS

BACKGROUND OF THE INVENTION

1. Field of the Invention

The present invention relates generally to improvements in portable spas, and more particularly, pertains to new and improved waterfall features for portable spas.

2. Description of the Prior Art

In the field of portable spas, it has been the practice to continually improve the spa experience by, not only increasing the number and variety of massaging jets available in the spa, but by also providing additional distractions that go beyond physical sensory stimulation to include audio stimulation, such as providing music to further enhance the spa experience. The present invention goes beyond providing stimulation for the sensory perceptions of touch and sound by providing visual distractions in the form of waterfalls flowing into the main body of water of the portable spa.

SUMMARY OF THE INVENTION

An elongated spout forms the output of a plenum chamber that is filled with water flow into an input orifice that is greater in cross-section than the output spout. An elongated light source mounted near the mouth of the spout lights up the ribbon-shaped water flow from the spout. The plenum chamber is formed to buffer the input flow so as to maintain a constant output flow. The elongated spout is located on or at the top rim of the spa so that a ribbon of water falls into the spa from the top of the spa.

BRIEF DESCRIPTION OF THE DRAWINGS

The exact nature of the present invention, as well as its objects and many advantages, will become readily apparent from consideration of the following detailed description in conjunction with the accompanying drawings in which like reference numerals designate like parts throughout the figures thereof and wherein.

DETAILED DESCRIPTION OF THE PREFERRED EMBODIMENTS

Reference will now be made to the preferred embodiments of the invention, examples of which are illustrated in the accompanying drawings. While the invention will be described in conjunction with the preferred embodiments, it will be understood that these embodiments are not intended to limit the invention. On the contrary, the intention is intended to cover alternatives, modifications and equivalents, which may be included within the spirit and scope of the invention as defined by the appended claims. In the following detailed description, numerous specific details are set forth in order to provide a thorough understanding of the present invention. However, it will be understood by one of ordinary skill in the art that the present invention may be practiced without these specific details. In other instances, well known methods, procedures, components, and circuits have not been described in detail so as not to unnecessarily obscure the important aspects of the present invention.

Figure 1:
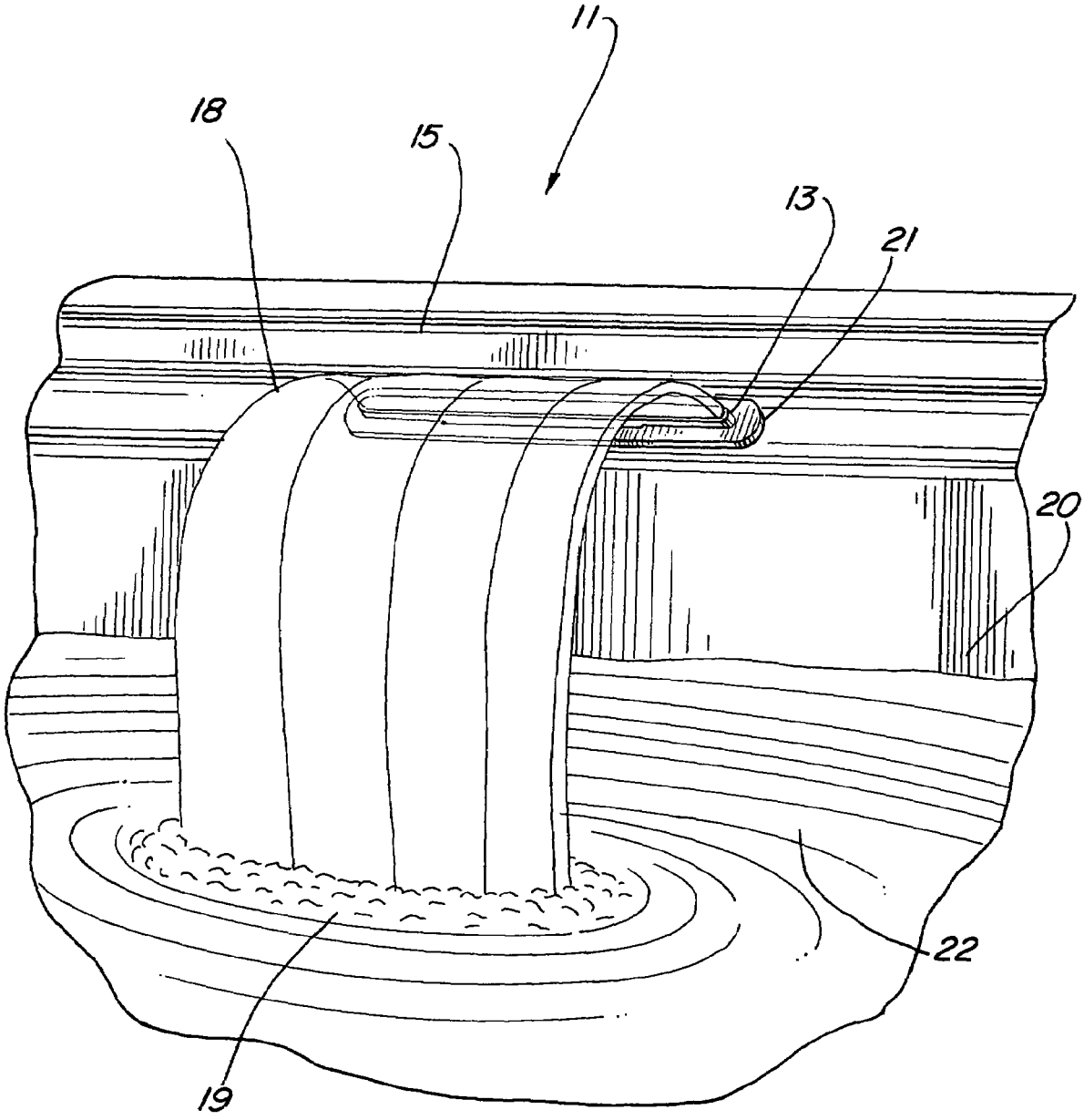
FIG. 1 is a perspective of a ribbon waterfall according to the present invention.

FIG. 1 illustrates a preferred embodiment of a waterfall feature 11 according to the present invention, designed to appeal to the visual senses of persons seated in the main body of water 22 of the portable spa container 20. A narrow elongated spout 13 is mounted in the top rim 15 of the portable spa 20. A bezel 21 smoothes the transition between the spout 13 and top rim 15. A ribbon-shaped flow of continuous water 18 is emitted in an arch from the spout 13 into the main body of water 22 in the portable spa container 20.

It is contemplated that a light source will light up the ribbon of water flow 18 in a variety of colors as desired. When the waterfall 18 hits the main body of water 22, light 19 carried by the waterfall is reflected in all directions.

Figure 2:
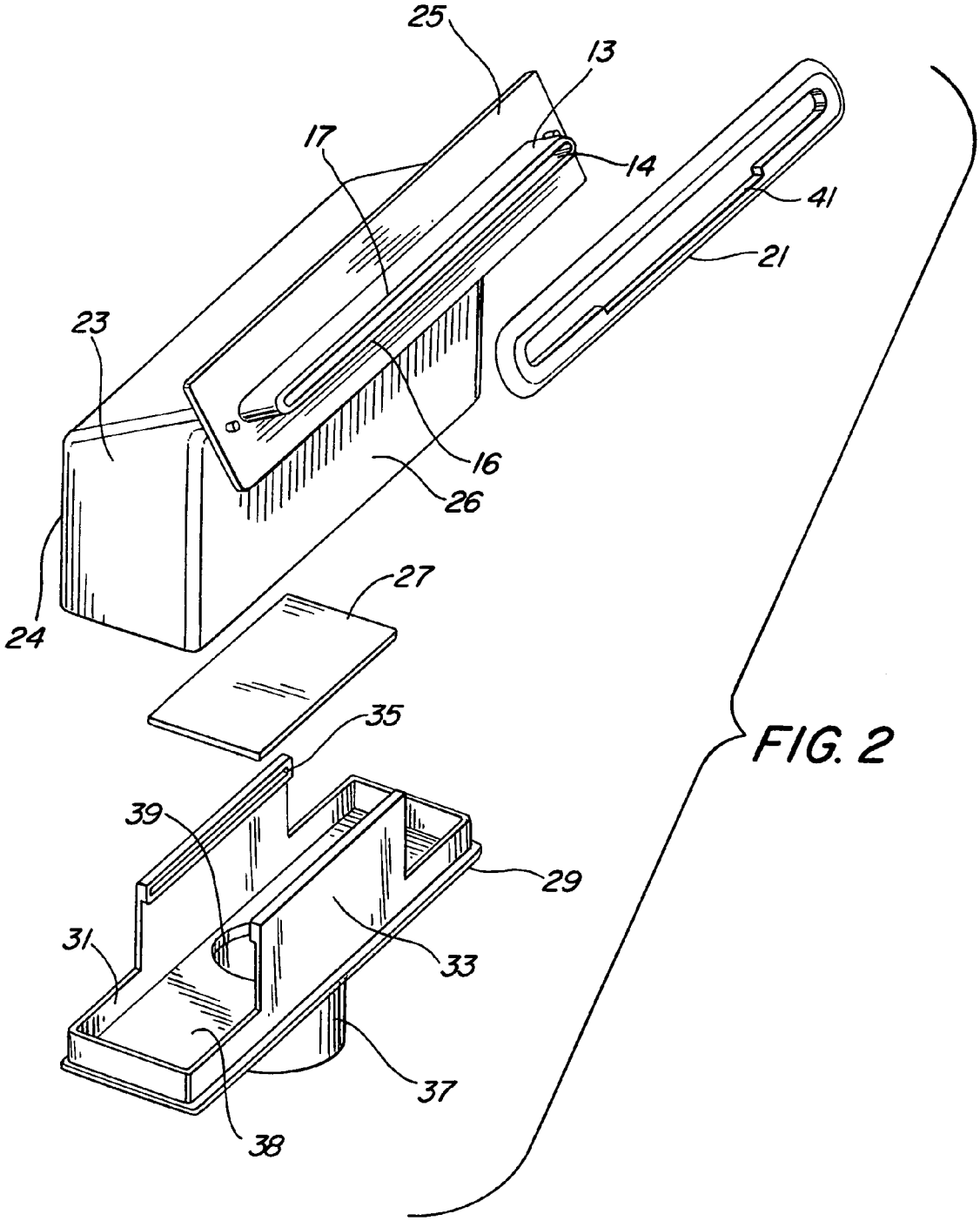
FIG. 2 is an exploded perspective of a preferred embodiment of a ribbon waterfall apparatus according to the present invention.
Figure 9:
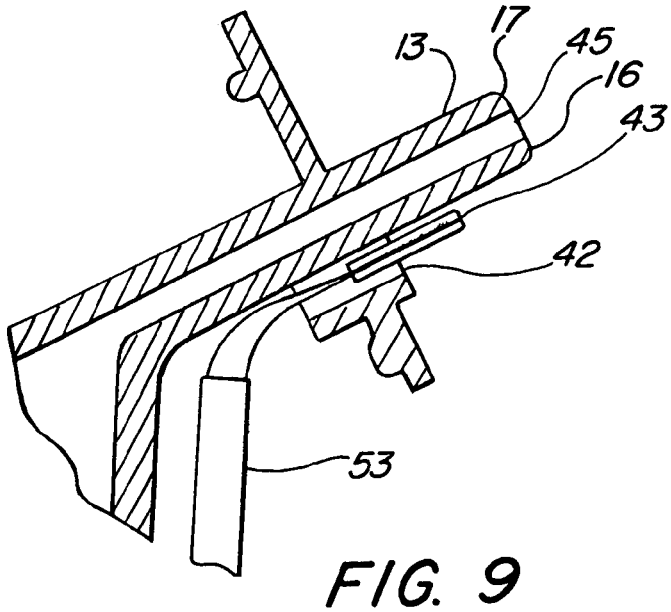
FIG. 9 is an exploded view of the spout portion of FIG. 5.

The main components of the waterfall structure are shown in FIG. 2. The spout 13 has an elongated mouth 14 with a top 17 and bottom 16 and a mounting plate 25. The mounting plate is used to attach the waterfall structure to the top rim of the spa. The output end 30 of a plenum chamber 23 having walls 24, 26 is attached to the spout 13. The walls 24, 26 form the outlet 30 of the plenum chamber 23. Once the spout 13 passes through the top rim of the portable spa and is attached to the rim material, a bezel 21 is mounted over the spa 13. A cutout notch 41 on the bezel makes room for a light source 43 mounted underneath the spout 13 (FIG. 9).

The inlet part of plenum chamber 23 is a separate inlet structure 29 that has a pipe connector 37 connected to a bottom plate 38 having an orifice 39. The bottom plate 38 is sized to fit within the bottom opening of plenum chamber 23. The water inlet 29 fits into and is permanently fastened to the walls 24 26 of the plenum chamber 23. The orifice 39 is chosen so that it is larger in cross-section than the opening of spout 13.

Bottom plate 38 has a wall 31 around the perimeter. The walls slide into the inside of the plenum chamber 23. The longer sides of bottom plate 38 have a pair of extended walls 33 with grooves 35 at their upper perimeter. A plate 27 is dimensioned to fit within grooves 35. This places plate 27 some distance from and over the orifice 39 in bottom plate 38. The plate 27 is a baffle that acts to buffer and deflect water surges entering the plenum chamber 23 through orifice 39, causing the water to flow around baffle plate 27 over the lower side walls 31 into the remaining spaces of plenum chamber 23.

Figure 3:
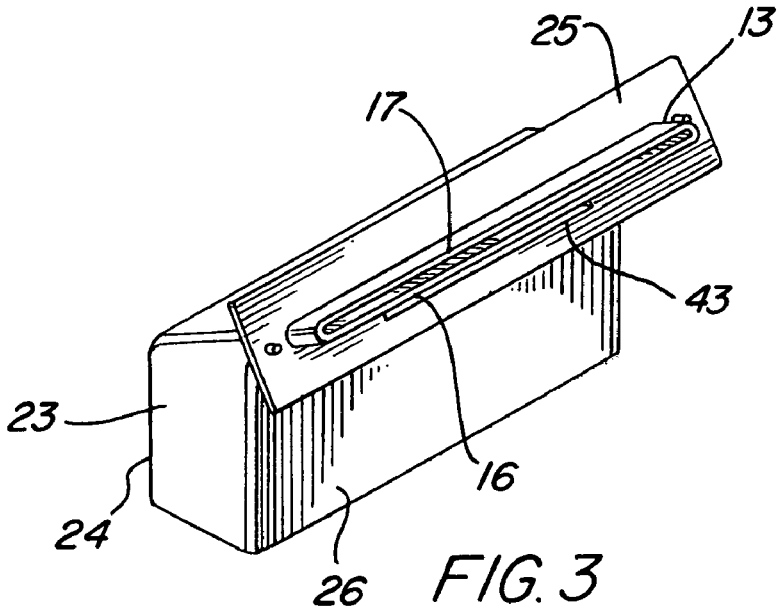
FIG. 3 is a perspective of the spout and plenum chamber of the waterfall of the present invention.

FIG. 3 illustrates a light source 43 located along the bottom of the spout. The light source 43 is thin and long and stretches almost the entire length of spout 13. It can be any number of light sources such as LED's or a row of fiber optics.

Figure 7:
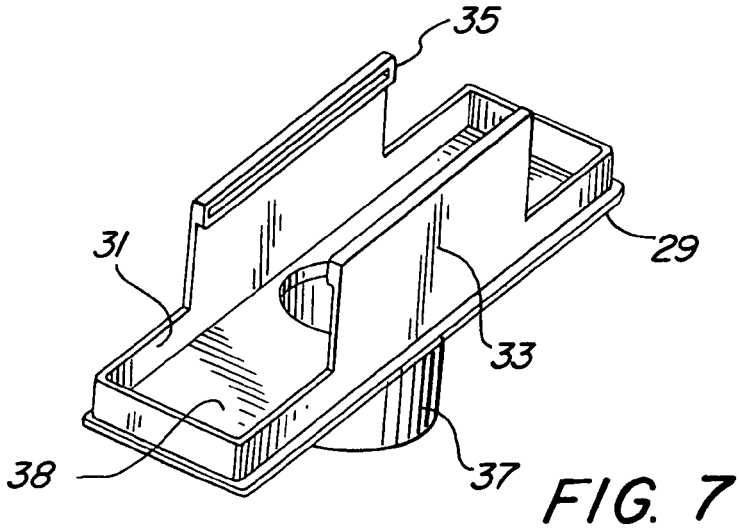
FIG. 7 is a perspective of the inlet structure of a plenum chamber of the waterfall according to the present invention.

FIG. 7 illustrates the bottom inlet part of plenum chamber 23, and more specifically, the extended portions 33 along the longer sides of bottom plate 38. The extended portions 33 are selected to be at a level to most efficaciously cause any surging flow into the plenum chamber through pipe connector 37 to be subdued and thereby prevent pulsing in the waterfall emitting from the spout.

Figure 4:
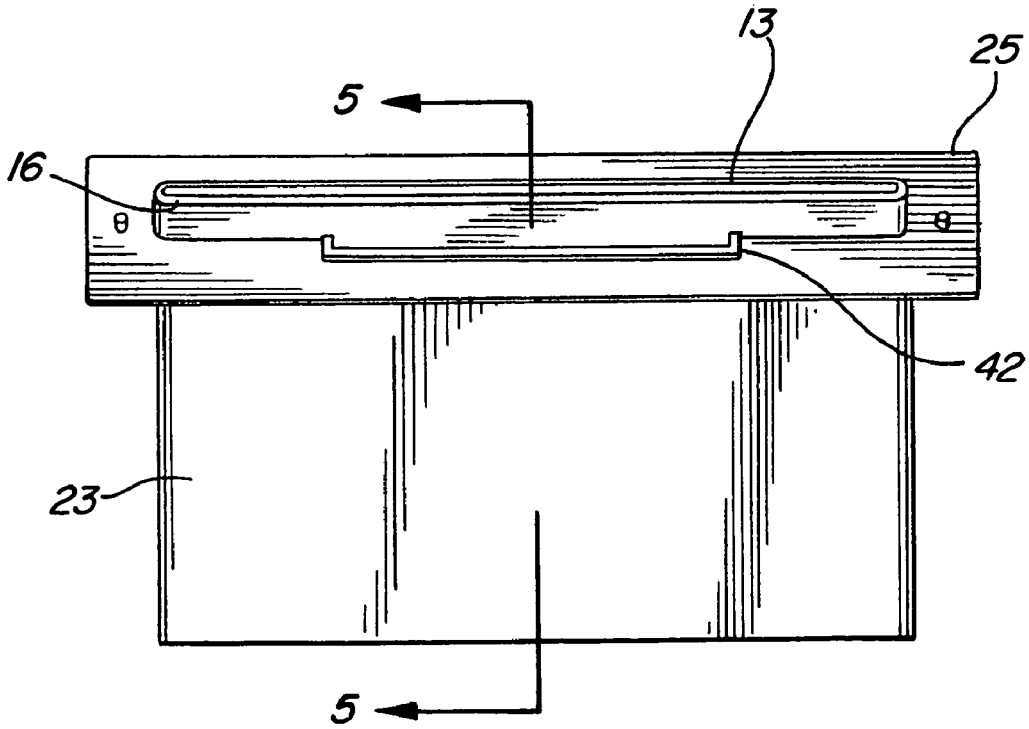
FIG. 4 is a front plan view of the plenum chamber of FIG. 3.

FIG. 4 illustrates the front view of the waterfall structure with the spout 13 extending past the mounting plate 25 with a slot 42 in mounting plate 25 for insertion of the light source 43 (FIG. 9).

Figure 5:
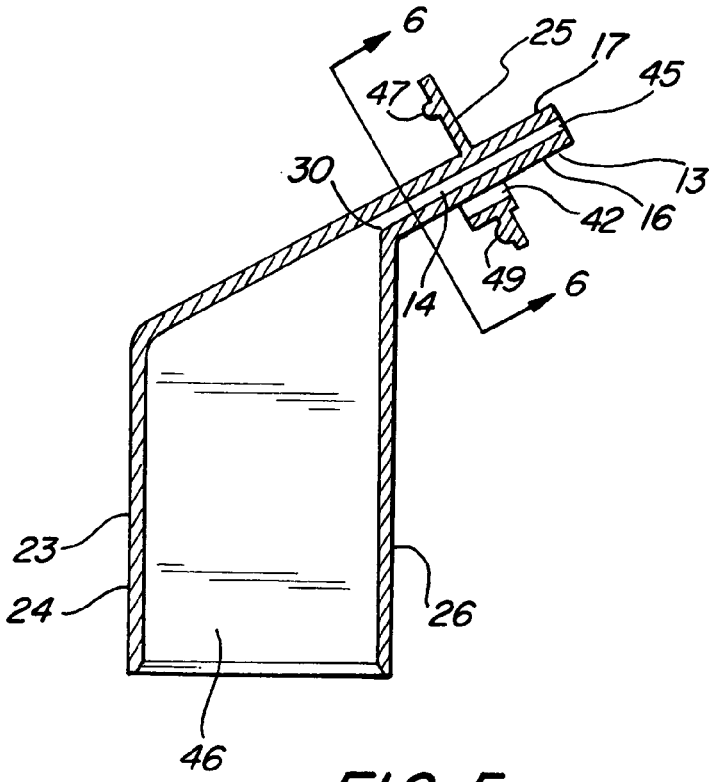
FIG. 5 is a cross-section of FIG. 4 taken along the line 5-5.

FIG. 5 illustrates more clearly, in cross-section, the spout portion of the output of plenum chamber 23. The spout 13 is formed from the walls 24, 26 of plenum chamber 23 to create a narrow elongated channel 45 leading from the main chamber 46 and ending in an elongated mouth 14 having a top 17 and a bottom 16. The mounting plate 25 is attached to the spout and has a location ridge 47 at the top, and a slot 42 at its bottom with another location ridge 49 beneath. As indicated in FIG. 5, mounting plate 25 may be formed from the walls (24. 26) of the plenum chamber 23.

Figure 6:
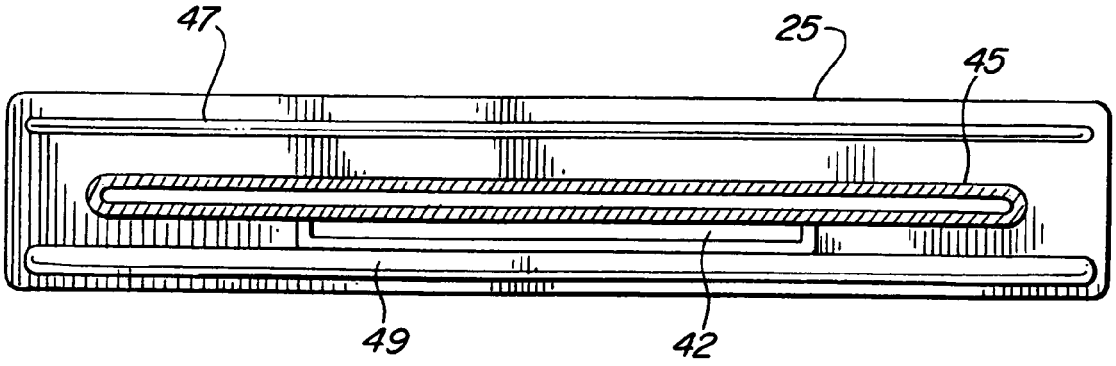
FIG. 6 is a cross-section of FIG. 5 taken along the line 6-6.

FIG. 6 provides a clear cross-sectional view of the spout opening 45 and slot 42 mounted beneath the spout, location ridges 47 on top and 49 on the bottom.

Figure 8:
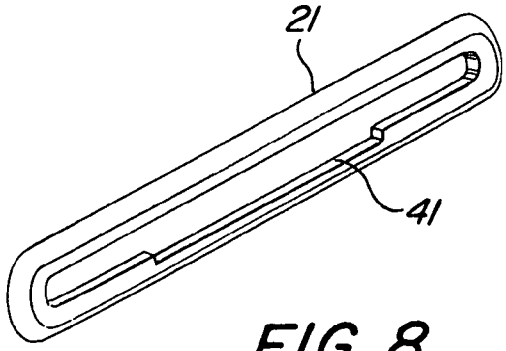
FIG. 8 is a perspective of a preferred embodiment of the bezel according to the present invention.

FIG. 8 shows the bezel 21 with a cutout portion 41 that goes around the light source 43 that is placed into slot 42 of mounting plate 25. As shown in FIGS. 1, 2 and 9 the bezel 21 of FIG. 8 attaches to mounting plate 25 and encompasses spout 13 and light source 43.

FIG. 9 illustrates the use of fiber-optic bundle 53 to provide light to a light head 43 which is inserted into the slot 42 from the back side. The slot 42 is attached to the bottom 16 of the spout 13. As shown in the figure, fiber-optic bundle 53 may be a flat array that directs light in a direction parallel to water flow through spout 13 to intersect the water falling out of the spout.

What is claimed is:

1. In combination with a spa having a container (20) for holding water with a top rim (15) the improvement being a waterfall structure comprising:

a plenum chamber (23) having walls (24, 26), a water inlet (39) and a water outlet (30), the outlet being formed from the walls (24, 26) of the plenum chamber;

a spout (13) formed from the walls (24, 26) of the plenum chamber as a continuation of the water outlet (30), the spout (13) passing through the top rim and having a narrow and elongated mouth (14) and a top (17) and bottom (16);

a mounting plate (25) bordering the top and the bottom of the spout where the spout passes through the top rim; and a light source (43) attached through the mounting plate at the bottom (16) of the spout (13) to inject light directly into water falling out of the spout (13).

2. The waterfall of claim 1 wherein the plenum chamber has a baffle (27) to prevent pressure surges.

3. The waterfall of claim 1 wherein the water inlet (29) of the plenum chamber (23) is larger in cross-section than the water outlet (30).

4. The waterfall of claim 1 further comprising a bezel (21) attached to the mounting plate (25) and encompassing the spout and the light source.

5. The waterfall of claim 4 wherein the light source (43) is a flat fiber-optic array.

6. The waterfall of claim 5 wherein the flat fiber-optic array directs light in a direction parallel to water flow through the spout to intersect the water falling out of the spout.

7. The waterfall of claim 1 further comprising a bezel (21) shaped to fit over the spout after it is mounted.

8. The waterfall of claim 1 wherein the water inlet (29) is a separate structure from the plenum chamber (23) that fits into and is permanently fastened to the walls (24, 26) of the plenum chamber (23).

9. The waterfall of claim 8 wherein the water inlet (29) has an inlet orifice (39) and water pipe connector (37).

10. The waterfall of claim 1 wherein the water inlet (29) has a baffle plate (27) mounted some distance from and over the inlet orifice (39), causing water flowing through the inlet orifice to strike the baffle plate and flow around it.

11. The waterfall of claim 1 wherein the mounting plate is formed from the walls (24, 26) of the plenum chamber.

* * * * *